US006830481B1

(12) United States Patent
Umeshita et al.

(10) Patent No.: US 6,830,481 B1
(45) Date of Patent: Dec. 14, 2004

(54) FUSE CONNECTION BOX AND METHOD FOR PRODUCING THE SAME

(75) Inventors: Masahiro Umeshita, Tokyo (JP); Kazuo Miyajima, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/659,999

(22) Filed: Sep. 12, 2000

(30) Foreign Application Priority Data

Sep. 13, 1999 (JP) ..... 11-258343

(51) Int. Cl.[7] ..... H01R 13/68
(52) U.S. Cl. ..... 439/621; 439/687; 439/696
(58) Field of Search ..... 439/621, 622, 439/687, 696, 906, 620

(56) References Cited

U.S. PATENT DOCUMENTS 4,391,485 A * 7/1983 Urani ..... 439/687
4,466,683 A * 8/1984 Ballarini ..... 439/571
4,758,184 A * 7/1988 Call ..... 439/622
4,941,851 A * 7/1990 Hsueh ..... 439/621
5,118,306 A * 6/1992 Bixler et al. ..... 439/405
5,447,452 A * 9/1995 Takano ..... 439/695
5,618,209 A * 4/1997 Lin et al. ..... 439/621
5,668,698 A * 9/1997 Jozwiak et al. ..... 361/752
5,700,165 A * 12/1997 Harris et al. ..... 439/621
5,906,514 A * 5/1999 Nelson, Jr. ..... 439/621
6,109,973 A * 8/2000 Gronowicz, Jr. et al. ... 439/620
6,146,206 A * 11/2000 Konno et al. ..... 439/621
6,162,097 A * 12/2000 Liang ..... 439/621
6,190,207 B1 * 2/2001 Wang ..... 439/622

* cited by examiner

*Primary Examiner*—Gary Paumen
*Assistant Examiner*—Edwin A. Leon
(74) *Attorney, Agent, or Firm*—Knobbe Martens Olson & Bear LLP

(57) ABSTRACT

A fuse connection box enabling efficient assembly without requiring a bag for protection of the terminal to be assembled in the housing, wherein the housing for attachment of fuses is divided into an input side housing in which an input side terminal of the end of the input side wire is assembled and an output side housing in which an output side terminal of the end of the output side wire is assembled, the input side housing and the output side housing have engagement portions with each other, and these are engaged to form a single housing able to have fuses attached to it. The fuse connection box can be assembled by separately assembling the input side terminal attached to the end of the input side wire into the input side housing and assembling the output side terminal attached to the end of the output side wire into the output side housing, then connecting the input side housing and output side housing. Therefore, the bag for protection of the terminal becomes unnecessary and assembly can be performed efficiently.

7 Claims, 5 Drawing Sheets

FUSE CONNECTION BOX AND METHOD FOR PRODUCING THE SAME

BACKGROUND OF THE INVENTION

1. Background of the Invention

The present invention relates to a fuse connection box used for internal wiring of an automobile and a method for producing the same.

2. Description of the Related Art

FIG. 1 and FIG. 2 show a fuse connection box of the related art. In FIGS. 1 and 2, 10 represents a plastic housing, 12 a protective cover connected to the housing 10 through hinges 14, 16 a fuse (plate fuse), 16A an input terminal of a fuse 16, 16B an output terminal of a fuse 16 (there is no distinction between an input terminal and output terminal in a fuse, but for convenience in explanation, 16A is made the input terminal and 16B the output terminal), 18 an input side wire, and 20 an output side wire.

As illustrated, the fuse connection box of the related art is formed with a one-piece housing 10. On the other hand, input side wires 18 and output side wires 20 are produced by different processes. The assembly into the housing is also performed as a different process.

FIG. 1 shows the state of an input side terminal (not shown) attached to an end of the input side wire 18 assembled in the housing.

Next, as illustrated in FIG. 2, an output side terminal (not shown) attached to an end of the output side wire 20 is assembled in the housing 10. By attaching the fuses 16 and covering the assembly with the protective cover 12 in this state, the fuse connection box is completed.

As explained above, since the input side wires 18 and the output side wires 20 are produced by separate processes and are assembled in the housing 10 by a separate process, the output side wires 20 to be later attached to the housing 10 (sometimes the input side wires 18 as well) have to have the output side terminals attached to their ends covered by protective bags 24 as shown in FIG. 3 to prevent short-circuits or other problems in the output side terminals attached to the ends in the period from production to assembly in the housing 10. Further, the bags 24 had to be removed when assembling the output side terminals 22 in the housing 10.

In this way, the fuse connection box of the related art required bags 24 for protecting the terminals of the ends of the wires to be attached to the housing later. It suffers from the disadvantage that time is taken for the bags 24 to be attached and removed.

SUMMARY OF THE INVENTION

An object of the present invention is to provide a fuse connection box and a method of producing the same which enable efficient assembly without requiring protective bags.

To achieve this object, according to a first aspect of the present invention, there in provided a fuse connection box comprised of a fuse and a housing for attaching the fuse, wherein said housing is divided into a first side housing in which a first side terminal of an end of a first side wire is assembled and a second side housing in which a second side terminal of an end of a second side wire is assembled, the first side housing and second side housing have portions for engagement with each other, and the first side housing and the second side housing are engaged to form a single housing in which the fuse can be attached.

By configuring the fuse connection box in this way, the fuse connection box can be assembled by separately assembling the first side terminal attached to the end of the first side wire into the first side housing and assembling the second side terminal attached to the end of the second side wire into the second side housing, then connecting the first side housing and second side housing. Therefore, the bags for protection of the terminals used in the past become unnecessary and assembly can be performed efficiently.

Preferably, the first side housing and the second side housing are of identical shapes having first engagement portions at one end in the direction of arrangement of fuses and having second engagement portions of shapes engaging with the first engagement portions at the other end.

By doing this, since the first side housing and second side housing can be produced by the same mold, the cost becomes cheaper. Further, since there is no need to differentiate between the first side housing and second side housing, part control becomes easy.

Preferably, there is further provided a protective cover attached to the first side housing and second side housing so as to cover the fuse in a state where the first side housing and the second side housing are connected and the fuse is attached.

Preferably, the protective cover is formed with a protective frame for preventing action of an external force on an engagement portion between the protective cover and the first side housing and second side housing.

This is preferable to prevent the protective cover from detaching.

According to a second aspect of the present invention, there is provided a method for producing a fuse connection box including a fuse and a housing for attaching the fuse, comprising the steps of producing separately a first side housing in which a first side terminal of an end of a first side wire is assembled and having an engagement portion and a second side housing in which a second side terminal of an end of a second side wire is assembled and having an engagement portion, engaging the engagement portions of the first side housing and second side housing to join them, and attaching a fuse to the joined housing.

BRIEF DESCRIPTION OF THE DRAWINGS

These and other objects and features of the present invention will become clearer from the following description of the preferred embodiments given with reference to the accompanying drawings, in which:

FIG. 4A is a perspective view illustrating the state before connecting the input side housing and output side housing and FIG. 4B is a perspective view of the state after connecting the two housings;

DESCRIPTION OF THE PREFERRED EMBODIMENTS

A preferred embodiment of the present invention will be described in detail with reference to the drawings.

Figure 1:
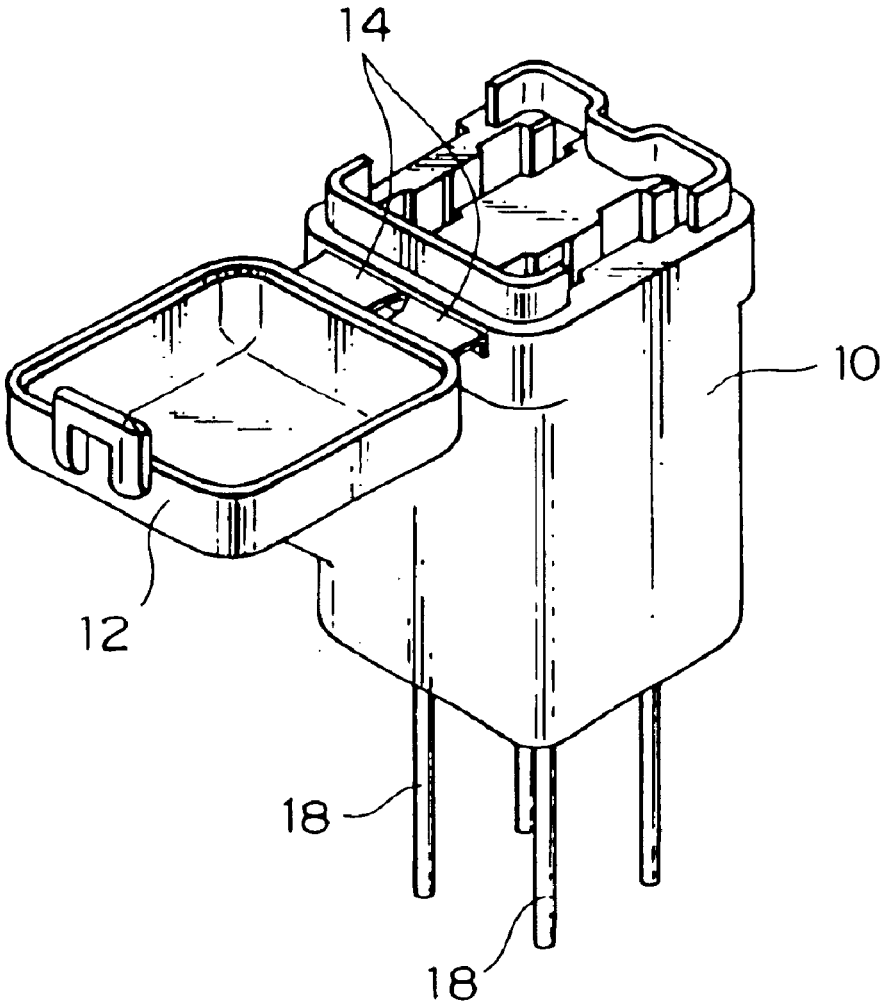
FIG. 1 PRIOR ART
FIG. 1 is a perspective view of a fuse connection box of the related art.
Figure 2:
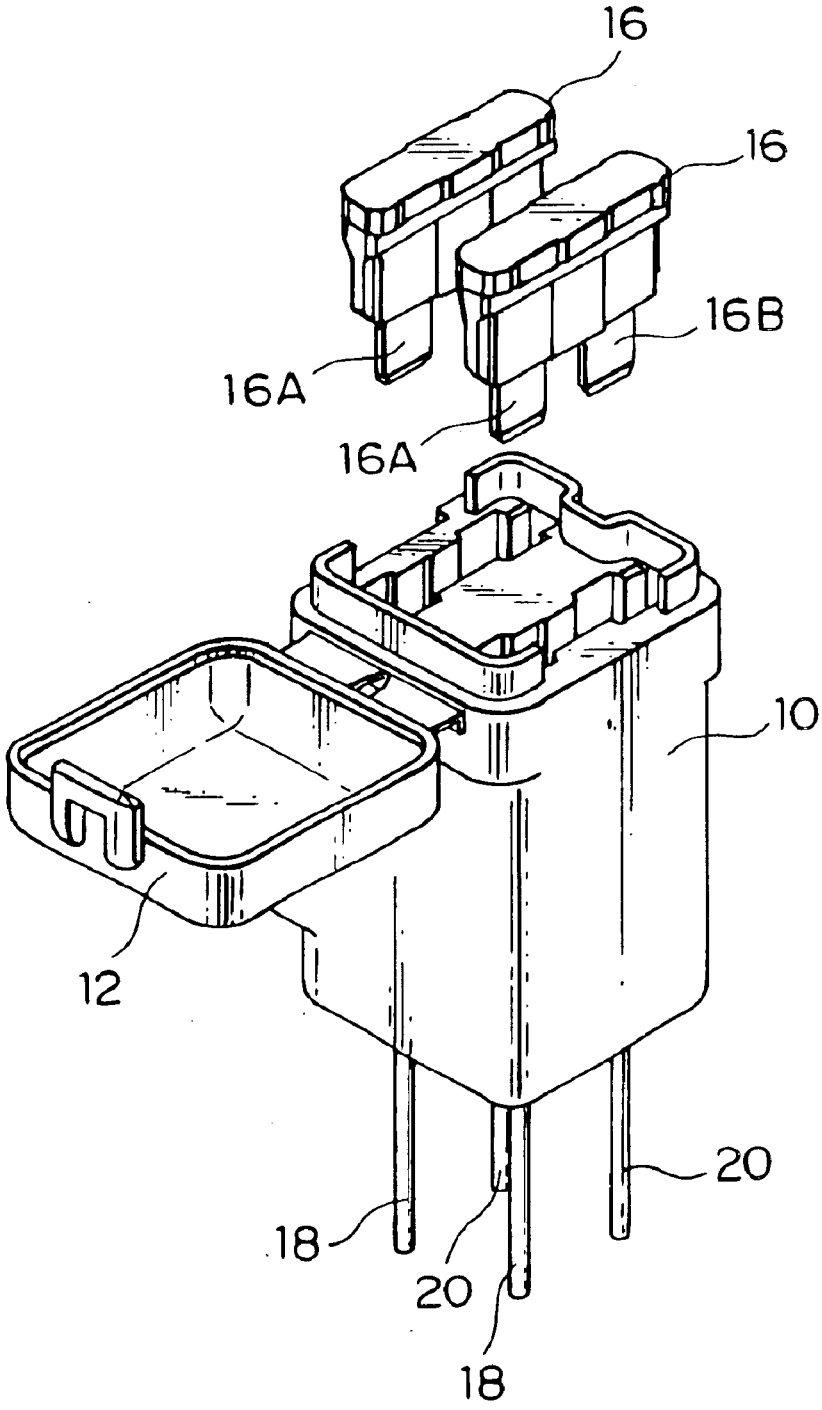
FIG. 2 PRIOR ART
FIG. 2 is a perspective view of the state before attachment of fuses to a fuse connection box illustrated in FIG. 1.
Figure 3:
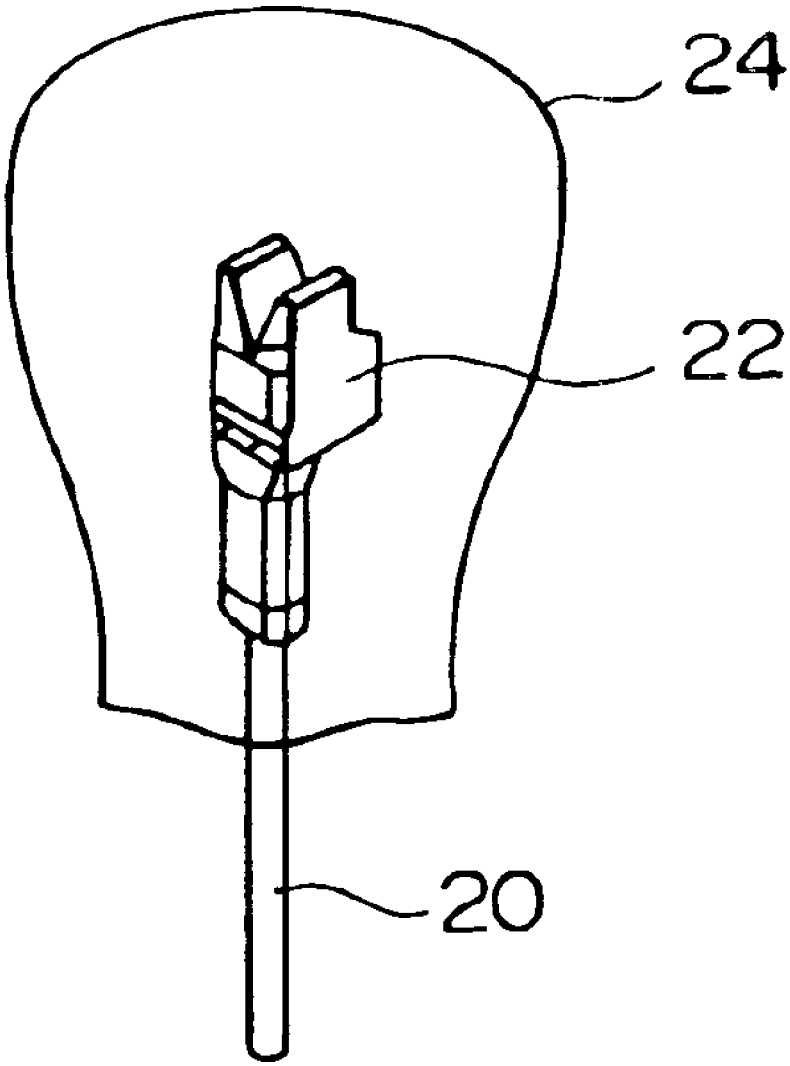
FIG. 3 PRIOR ART
FIG. 3 is a perspective view of an output side terminal attached to an end of an output side wire in the state before assembling into the housing in the fuse connection box of the related art.
Figure 4A:
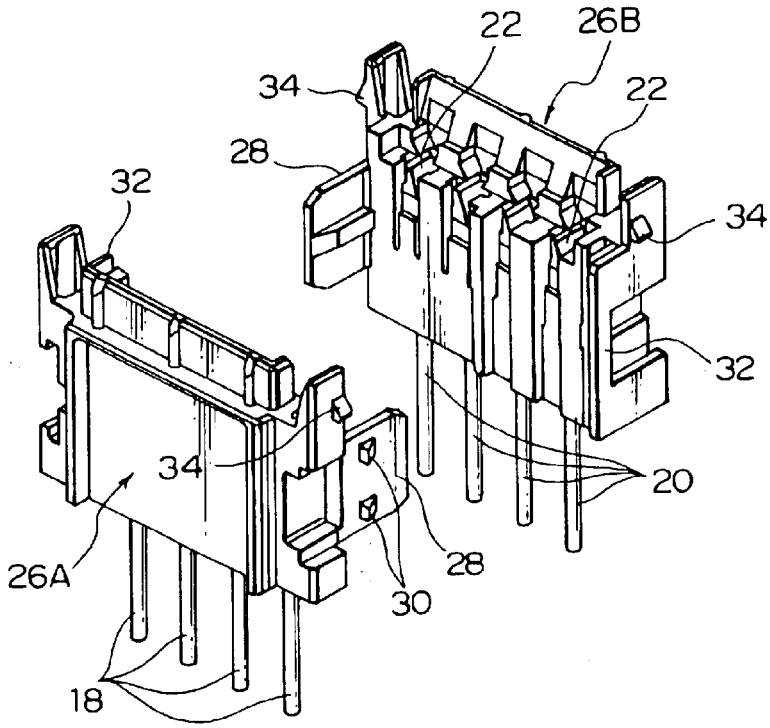
FIG. 4A and FIG. 4B show an embodiment of a fuse connection box of the present invention and a method of producing a fuse connection box, where

FIGS. 4A and 4B to FIG. 6 show an embodiment of the present invention. This fuse connection box, as shown in FIG. 4A, is comprised of an input side housing 26A serving as a first side housing of the present invention in which input side terminals (not shown) of ends of input side wires 18 serving as first side wires of the present invention are assembled and an output side housing 26B serving as a second side housing of the present invention in which output side terminals 22 of ends of output side wires 20 serving as second side wires of the present invention. The method of assembling the input side terminals in the input side housing 26A and the method of assembling the output side terminals 22 in the output side housing 26B are similar to those of a housing of the related art.

The input side housing 26A and the output side housing 26B are identical in shape and have guide pieces 28 and engagement projections 30 (first engagement portions) formed at the outside surface at one end of the direction of arrangement of the terminals and have engagement frames 32, (second engagement portions) of shapes engaging with the engagement protections 30 at the other end. Further, the input side housing 26A and the output side housing 26B are further formed with engagement projections 34 for attaching the later described protective cover to the top of the two ends of the direction of arrangement of terminals.

Figure 4B:
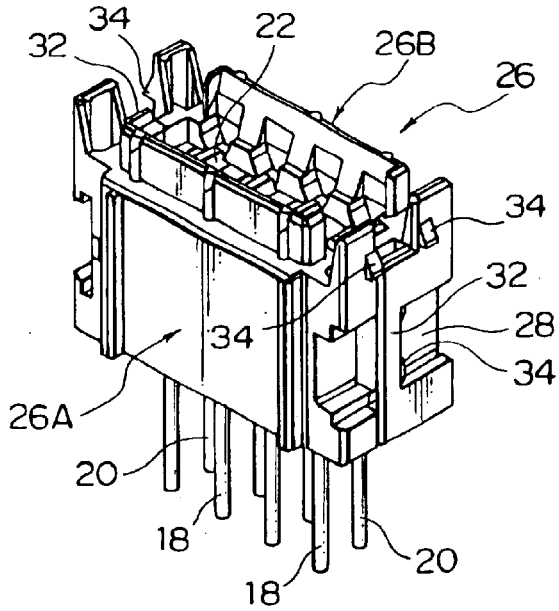

When the input side housing 26A and the output side housing 26B configured in this way are made to face each other as illustrated in FIG. 4A and are pushed together so that the guide pieces 28 are inserted inside the engagement frame part 32, the engagement frame parts 32 engage with the engagement projections 30 as illustrated in FIG. 4B. As a result, the input side housing 26A and the output side housing 26B are connected with each other and a single housing 26 able to have fuses attached to it is formed.

Figure 5:
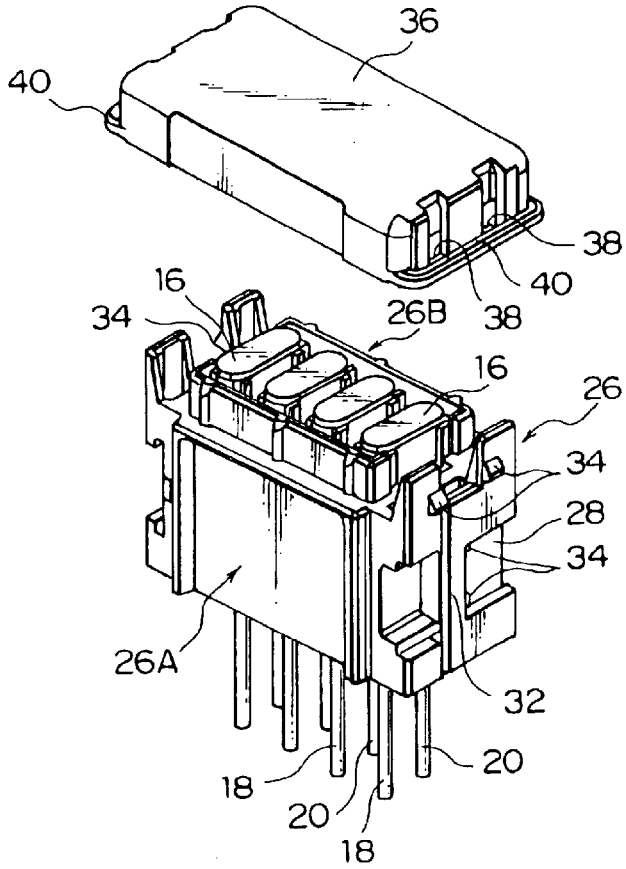
FIG. 5 is a perspective view of the state before attaching the fuses in the housing illustrated in FIG. 4B and covering them with a protective cover.
Figure 6:
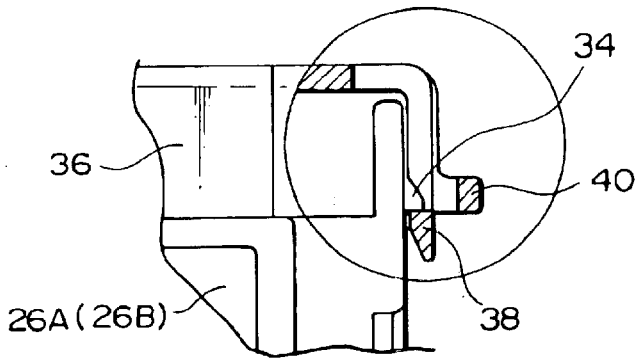
FIG. 6 is a sectional view of the state of connection of the protective cover and housing after covering by the protective cover from the illustrated state.

Next, the fuses 16 are attached to the housing 26 as illustrated in FIG. 5 and the protective cover 36 is attached. The method of attaching the fuses 16 is the same as with the fuse connection box of the related art. The protective cover 36 is formed with engagement pieces 38 for engagement with the engagement projections 34 of the housing 26 (see FIG. 6). By engaging the engagement pieces 38 with the engagement projections 34, the protective cover 36 is attached to the housing 26. Further, the protective cover 36 is formed with a protective frame 40 so as to surround the engagement portions of the engagement pieces 38 and engagement projections 34. This protective frame 40 is designed to prevent external force from being applied to the engagement portions of the engagement pieces 38 and the engagement projections 34 and to thereby keep the protective cover 36 from detaching from the housing 26.

As described above, according to the present invention, since the housing is divided into an input side housing serving as the first side housing and an output side housing serving as the second side housing, the assembly of the input side terminals attached to the ends of the input side wires serving as the first side wires into the input side housing and the assembly of the output side terminals attached to the ends of the output side wires serving as the second side wires in the output side housing can be performed by separate processes. Next, by connecting the input side housing and the output side housing, the fuse connection box can be assembled. As a result, it is possible to omit the bags for terminal protection which had been used in the related art and to efficiently assemble the fuse connection box.

While the invention has been described with reference to specific embodiment chosen for purpose of illustration, it should be apparent that numerous modifications could be made thereto by those skilled in the art without departing from the basic concept and scope of the invention.

What is claimed is:

1. A method of assembling a fuse connection box comprising a fuse and a housing for attaching the fuse, said housing comprising a first side housing accommodating a fist side terminal and a second side housing accommodation a second side terminal, said first side housing and second side housing having portions for engagement with each other, said method including steps of:

pre-assembling said first side terminal attached to an end of a first side wire such that at least a large majority of the connection end of said first side wire is enclosed within said first side housing so as to provide first side terminal protection from damage prior to complete fuse connection box assembly;

pre-assembling said second side terminal attached to an end of a second side wire such that at least a large majority of the connection end of said second side wire is enclosed within said second side housing so as to provide second side terminal protection from damage prior to complete fuse connection box assembly; and engaging said first side housing and second side housing to form a single housing in which said fuse can be attached.

2. A method of assembling a fuse connection box as set forth in claim 1, wherein said first side housing and said second side housing are of identical shapes having first engagement portions at one end in the direction of arrangement of fuses and having second engagement portions of shapes engaging with the first engagement portions at the other end.

3. A method of assembling a fuse connection box as set forth in claim 1, additionally comprising a protective cover, wherein said protective cover is formed with a protective frame for preventing action of an external force on an engagement portion between said protective cover and said first side housing and second side housing.

4. A method of assembling a fuse connection box comprising a fuse and a housing for attaching the fuse, said housing comprising a fuse, a housing for attaching the fuse and protective cover, said housing comprising a first side housing accommodating a fist side terminal and a second side housing accommodation a second side terminal, said first side housing and second side housing having portions for engagement with each other, said first side housing and second side housing being of identical shapes having first engagement portions at one end in the direction of arrangement of fuses and having second engagement portions of shapes engaging with the first engagement portions at the other end, and said protective cover being attached to said first side housing and second side housing so as to cover said fuse in a state when said first side housing and said second side housing are connected and said fuse is attached, said method including steps of:

pre-assembling said first side terminal attached to an end of a first side wire such that at least a large majority of the connection end of said first side wire is enclosed within said first side housing so as to provide first side terminal protection from damage prior to complete fuse connection box assembly;

pre-assembling said second side terminal attached to an end of a second side wire such that at least a large majority of the connection end of said second side wire is enclosed within said second side housing so as to provide second side terminal protection from damage prior to complete fuse connection box assembly; and engaging said first side housing and second side housing to form a single housing in which said fuse can be attached.

5. A method of assembling a fuse connection box as set forth in claim 4, wherein said protective cover is formed with a protective frame for preventing action of an external force on an engagement portion between said protective cover and said first side housing and second side housing.

6. A method of assembling a fuse connection box as set forth in claim 5, further comprising a protective cover attached to said first side housing and second side housing so as to cover said fuse in a state where said first side housing and said second side housing are connected and said fuse is attached.

7. A method of assembling a fuse connection box as set forth in claim 6, wherein said protective cover is formed with a protective frame for preventing action of an external force on an engagement portion between said protective cover and said first side housing and second side housing.

* * * * *

UNITED STATES PATENT AND TRADEMARK OFFICE

CERTIFICATE OF CORRECTION

PATENT NO. : 6,830,481 B1
DATED : December 14, 2004
INVENTOR(S) : Umeshita et al.

It is certified that error appears in the above-identified patent and that said Letters Patent is hereby corrected as shown below:

Column 4,
Line 35, delete “fist” and insert -- first --.

Column 5,
Line 7, delete “fist” and insert -- first --.

Signed and Sealed this

Third Day of January, 2006

JON W. DUDAS
*Director of the United States Patent and Trademark Office*